US011525613B2

(12) United States Patent
Hayashi

(10) Patent No.: US 11,525,613 B2
(45) Date of Patent: Dec. 13, 2022

(54) ICE MAKING MACHINE

(71) Applicant: NIDEC SANKYO CORPORATION, Nagano (JP)

(72) Inventor: Katsuhiko Hayashi, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 0 days.

(21) Appl. No.: 16/979,388

(22) PCT Filed: Mar. 1, 2019

(86) PCT No.: PCT/JP2019/007974
§ 371 (c)(1),
(2) Date: Sep. 9, 2020

(87) PCT Pub. No.: WO2019/172096
PCT Pub. Date: Sep. 12, 2019

(65) Prior Publication Data

US 2021/0003334 A1 Jan. 7, 2021

(30) Foreign Application Priority Data

Mar. 9, 2018 (JP) ..... JP2018-042946

(51) Int. Cl.

| | |
|---|---|
| ***B60H 1/00*** | (2006.01) |
| ***B60H 1/32*** | (2006.01) |
| ***F25C 1/10*** | (2006.01) |
| ***F25C 1/25*** | (2018.01) |

(52) U.S. Cl.
CPC . *F25C 1/10* (2013.01); *F25C 1/25* (2018.01)

(58) Field of Classification Search
CPC ..... F25C 1/10; F25C 1/25; F25D 23/067
USPC ..... 62/356
See application file for complete search history.

(56) References Cited

U.S. PATENT DOCUMENTS 2,969,654 A * 1/1961 Harle ..... F25C 1/04 62/353
3,048,986 A * 8/1962 Archer ..... F25C 5/06 62/347
3,199,305 A * 8/1965 Frohbieter ..... F25C 1/04 62/344

(Continued)

FOREIGN PATENT DOCUMENTS

JP 2669941 B2 10/1997
JP 2012207824 A 10/2012

OTHER PUBLICATIONS

International Search Report for International Application No. PCT/JP2019-007974; dated Apr. 2, 2019.

*Primary Examiner* — Eric S Ruppert
*Assistant Examiner* — Kirstin U Oswald
(74) *Attorney, Agent, or Firm* — Cantor Colburn LLP

(57) ABSTRACT

An ice making machine may include an ice tray comprising a water storage recessed part in which water supplied from a water supply pipe is stored, a drive part structured to reverse the ice tray around an axial line passing the ice tray between a water storage position where the water storage recessed part faces an upper side and an ice separation position where the water storage recessed part faces a lower side, and a frame which supports the ice tray and the drive part. The frame includes a frame portion which is separated to a side from a turning locus formed by turning of the ice tray, and a water pouring part which is protruded from the frame portion to a side of the turning locus.

6 Claims, 9 Drawing Sheets

(56) References Cited

U.S. PATENT DOCUMENTS

| | | | | |
|---|---|---|---|---|
| 4,265,089 | A * | 5/1981 | Webb | F25D 21/02 62/353 |
| 2006/0086134 | A1* | 4/2006 | Voglewede | F25C 5/06 62/353 |
| 2008/0148750 | A1* | 6/2008 | Hsu | F25C 1/25 62/188 |
| 2009/0019880 | A1* | 1/2009 | Lee | F25C 1/10 62/73 |
| 2009/0145148 | A1* | 6/2009 | Liu | F25C 1/25 62/188 |
| 2009/0235682 | A1* | 9/2009 | Petrenko | F25D 21/08 62/449 |
| 2010/0024442 | A1* | 2/2010 | Damrath | F25D 23/12 62/347 |
| 2010/0064716 | A1* | 3/2010 | Park | F25C 5/187 62/340 |
| 2013/0239594 | A1* | 9/2013 | Lin | F25C 5/08 62/73 |
| 2013/0327074 | A1* | 12/2013 | Lee | F25C 1/04 62/177 |
| 2015/0241102 | A1* | 8/2015 | Lee | F25C 1/24 62/344 |
| 2016/0003514 | A1* | 1/2016 | Ji | F25C 5/08 62/351 |
| 2016/0252286 | A1* | 9/2016 | Jeong | F25C 1/18 62/130 |

* cited by examiner

ICE MAKING MACHINE

CROSS REFERENCE TO RELATED APPLICATION

This is the U.S. national stage of application No. PCT/JP2019/007974, filed on Mar. 1, 2019. Priority under 35 U.S.C. § 119(a) and 35 U.S.C. § 365(b) is claimed from Japanese Application No. 2018-042946 filed on Mar. 9, 2018, the disclosure of which is also incorporated herein by reference.

TECHNICAL FIELD

The present invention relates to an ice making machine structured to store water supplied through a water supply pipe and make ice pieces.

BACKGROUND ART

An ice making machine mounted on a refrigerator is described in Patent Literature 1. The ice making machine described in the literature includes an ice tray provided with water storage recessed parts, a drive part for reversing the ice tray around an axial line passing the ice tray, and a frame which supports the ice tray and the drive part. The ice making machine is structured so that water supplied from a water supply pipe is filled in the water storage recessed parts to perform ice making. Further, when the ice making is completed, the ice making machine reverses the ice tray by the drive part and makes a part of the ice tray abut with the frame to twist the ice tray. In this manner, ice pieces are separated from the ice tray and dropped to an ice storage container disposed on a lower side. In the Patent literature, a water supply port of the water supply pipe is located on an upper side with respect to the ice tray and water is directly poured into the ice tray.

CITATION LIST

Patent Literature

[PTL 1] Japanese Patent Laid-Open No. 2012-207824

SUMMARY OF THE INVENTION

Problems to be Solved by the Invention

In a case that a water supply pipe is disposed on an upper side with respect to the ice tray, the water supply pipe is required to separate from a turning locus of the ice tray to an upper side so that the water supply port of the water supply pipe is not interfered with the ice tray which is reversed (turned). Therefore, an installation space of the ice making machine including the water supply pipe is increased in an upper and lower direction.

In view of the problem described above, an objective of the present invention is to provide an ice making machine whose installation space including a water supply pipe can be reduced in an upper and lower direction.

Embodiments to Solve the Problems

To solve the above-mentioned problem, at least an embodiment of the present invention may provide an ice making machine including an ice tray provided with a water storage recessed part in which water supplied from a water supply pipe is stored, a drive part structured to reverse the ice tray around an axial line passing the ice tray between a water storage position where the water storage recessed part faces an upper side and an ice separation position where the water storage recessed part faces a lower side, and a frame which supports the ice tray and the drive part. The frame may be provided with a frame portion which is separated to a side from a turning locus formed by turning of the ice tray, and a water pouring part which is protruded from the frame portion to a side of the turning locus. The water pouring part may be, in a case that a state that the ice tray is located at the water storage position is viewed from an upper side, overlapped with an ice tray portion of the ice tray which is moved to a lower side when the ice tray starts turning in a first turning direction from the water storage position toward the ice separation position. An upper face of the frame portion may be provided with a water supply passage which is communicated with the water pouring part, and water from the water supply pipe may be supplied to the water supply passage and be poured into the water storage recessed part through the water pouring part.

In accordance with at least an embodiment of the present invention, water from a water supply pipe may be poured into a water supply passage provided in a frame portion of a frame which is located on a side of a turning locus of an ice tray, and the water may be flowed into a water pouring part from the water supply passage and be supplied to a water storage recessed part from the water pouring part. Therefore, a water supply port of the water supply pipe can be located on a side with respect to the ice tray. As a result, the water supply port of the water supply pipe is not required to dispose at a position separated from the turning locus of the ice tray on an upper side with respect to the ice tray and thus, an installation space of the ice making machine including the water supply pipe can be reduced in an upper and lower direction. Further, the water pouring part may be located at a position overlapped with the ice tray when the ice tray is located at the water storage position. Therefore, water which is poured from the water pouring part can be surely flowed into the ice tray. In addition, the water pouring part may be overlapped with an ice tray portion which is moved to a lower side when the ice tray starts turning in a first turning direction from the water storage position toward the ice separation position. Therefore, when viewed from an upper side, even in a case that the water pouring part and the turning locus of the ice tray are overlapped with each other, the water pouring part protruded from the frame portion and the ice tray being turned are not interfered with each other.

In at least an embodiment of the present invention, a tip end of the water pouring part may be located on a lower side with respect to an upper end of the ice tray when the ice tray is located at the water storage position. According to this structure, water which is poured into the ice tray from the water pouring part can be stored in the water storage recessed part without splashing. Further, the tip end of the water pouring part may be located on a side of a turning center of the ice tray with respect to the turning locus when the ice tray starts turning in the first turning direction.

In at least an embodiment of the present invention, the drive part may be connected with one side in a direction of the axial line of the ice tray, the frame portion may be provided with a facing portion which faces the drive part with the ice tray interposed therebetween in the direction of the axial line and an extended portion which is extended from the facing part to the one side in the direction of the axial line, and the water supply passage may be provided with a first water supply passage portion which is provided on an upper face of the facing part and a second water supply passage portion which is provided on an upper face of the extended part. According to this structure, the drive part and the water supply passage are easily separated from each other in the axial line direction. Therefore, even in a case that water poured into the water supply passage from the water supply pipe splashes, the water is prevented or restrained from splashing on the drive part. Further, the water supply passage is provided with the first water supply passage portion and the second water supply portion which are extended in a direction intersecting each other and thus, a degree of freedom of an arrangement of the water supply pipe for supplying water to the water supply passage is enhanced.

In at least an embodiment of the present invention, the ice tray may be made of flexible material, the facing portion may be provided with an abutted part which is abutted with the ice tray from a front side in the first turning direction when the ice tray is turned in the first turning direction and reaches the ice separation position and thereby, turning of the ice tray driven in the first turning direction is prevented, and, in a state that the ice tray is abutted with the abutted part, the water pouring part may be separated on the front side in the first turning direction of the ice tray. According to this structure, when the ice tray and the abutted part are abutted with each other and turning of the ice tray is prevented, the ice tray can be twisted. Therefore, ice pieces are easily separated from the ice tray when the ice tray has reached the ice separation position. Further, when the ice tray is abutted with the abutted part of the frame at the ice separation position, the ice tray is prevented from further being turned in the first turning direction from the ice separation position. Therefore, interference of the ice tray with the water pouring part is avoided.

In at least an embodiment of the present invention, a bottom face of the water supply passage may be inclined to a lower side toward the water pouring part. According to this structure, water supplied to the water supply passage is flowed toward the water pouring part without stagnating. Further, when water supply is stopped, the water is prevented or restrained from being left and frozen in the water supply passage.

In at least an embodiment of the present invention, the water supply passage may be provided with a water supply outlet which is opened in a face on a side where the ice tray is located in the frame portion, the water pouring part and the water supply passage may be communicated with each other through the water supply outlet, and the water pouring part may be provided with a bottom part whose upper face is continuously connected with a bottom face of the water supply passage through the water supply outlet and a pair of wall parts which are respectively protruded to a side of the ice tray from opening edge portions of the water supply outlet provided in the frame portion so as to face each other with the water supply outlet interposed therebetween, a lower end of each of the wall parts being connected with the bottom part. According to this structure, the water which is flowed out from the water supply outlet of the water supply passage can be guided along the upper face of the bottom part of the water supply part to lead to the ice tray.

In at least an embodiment of the present invention, the ice tray may be provided with a plurality of the water storage recessed parts and a communication part through which two water storage recessed parts adjacent to each other are partly communicated with each other. According to this structure, the water poured into the ice tray is easily flowed into and stored in all the water storage recessed parts through the communication part.

In at least an embodiment of the present invention, the ice making machine may include the water supply pipe, a connection water passage which connects a water tank with the water supply pipe, a valve structured to open and close the connection water passage, and a water supply control part structured to drive and control the valve to supply a predetermined amount of water to the ice tray from the water supply pipe. The water supply control part may be structured to repeat opening and closing of the valve while the predetermined amount of the water is supplied and the water is intermittently flowed out from the water supply pipe. According to this structure, an amount of water poured into the water supply passage from the water supply pipe at one time can be adjusted and thus, the water can be prevented from overflowing and splashing from the water supply passage and the water pouring part.

Effects of the Invention

In accordance with at least an embodiment of the present invention, a water supply port of the water supply pipe can be located on a side with respect to the ice tray. As a result, the water supply port of the water supply pipe is not required to dispose at a position separated from a turning locus of the ice tray on an upper side with respect to the ice tray and thus, an installation space of the ice making machine including the water supply pipe can be reduced in an upper and lower direction. Further, the water pouring part is located at a position overlapped with the ice tray when the ice tray is located at the water storage position. Therefore, water poured from the water pouring part can be flowed into the ice tray. In addition, the water pouring part is overlapped with an ice tray portion which is moved to a lower side when the ice tray starts turning in a first turning direction from the water storage position toward the ice separation position. Therefore, when viewed from an upper side, even in a case that the water pouring part and the ice tray are overlapped with each other, the ice tray being turned and the water pouring part are not interfered with each other.

DESCRIPTION OF EMBODIMENTS

An ice making machine in accordance with an embodiment of the present invention will be described below with reference to the accompanying drawings.

(Entire Structure)

Figure 1:
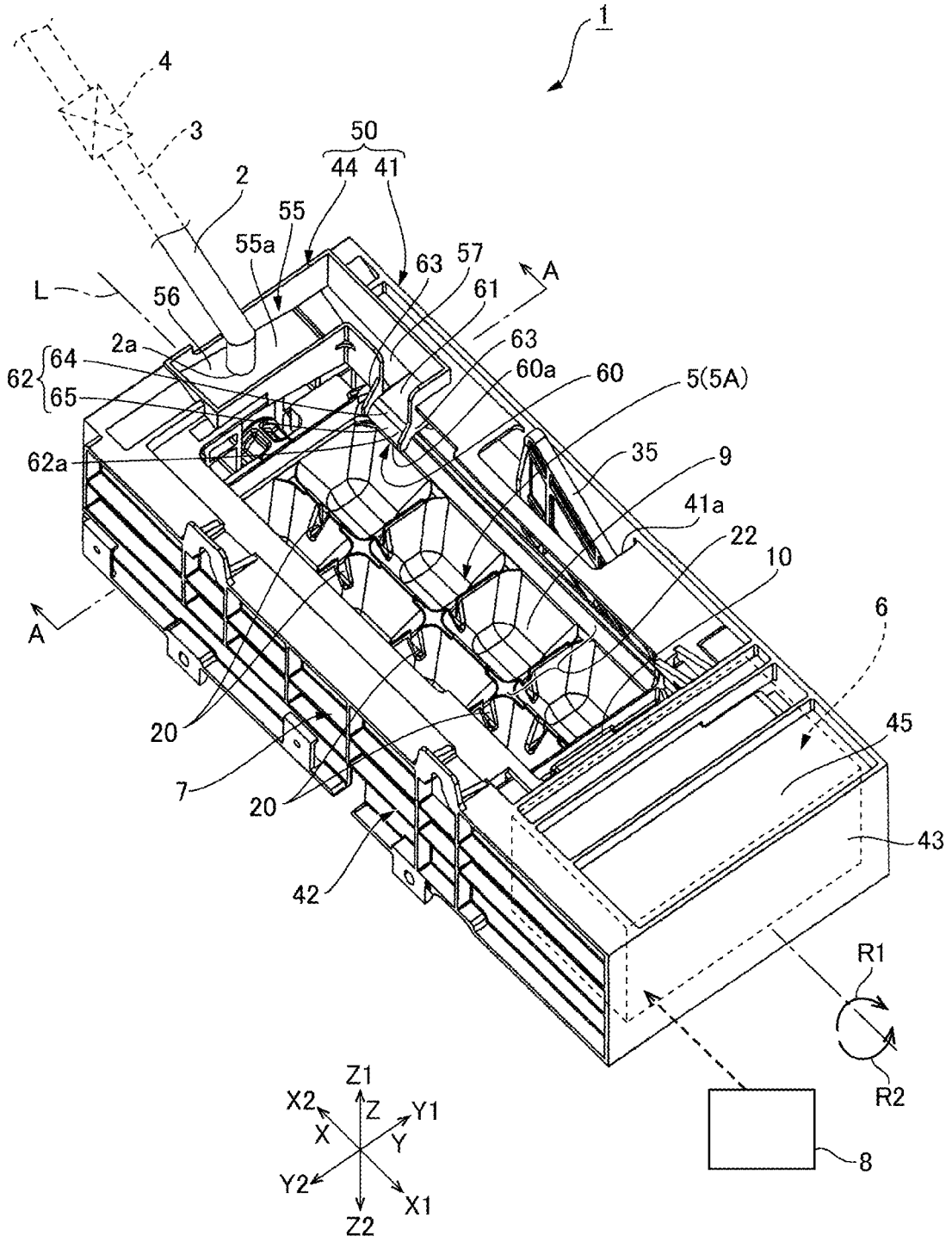
FIG. 1 is a perspective view showing an ice making machine to which at least an embodiment of the present invention is applied and which is viewed from an upper side.
Figure 2:
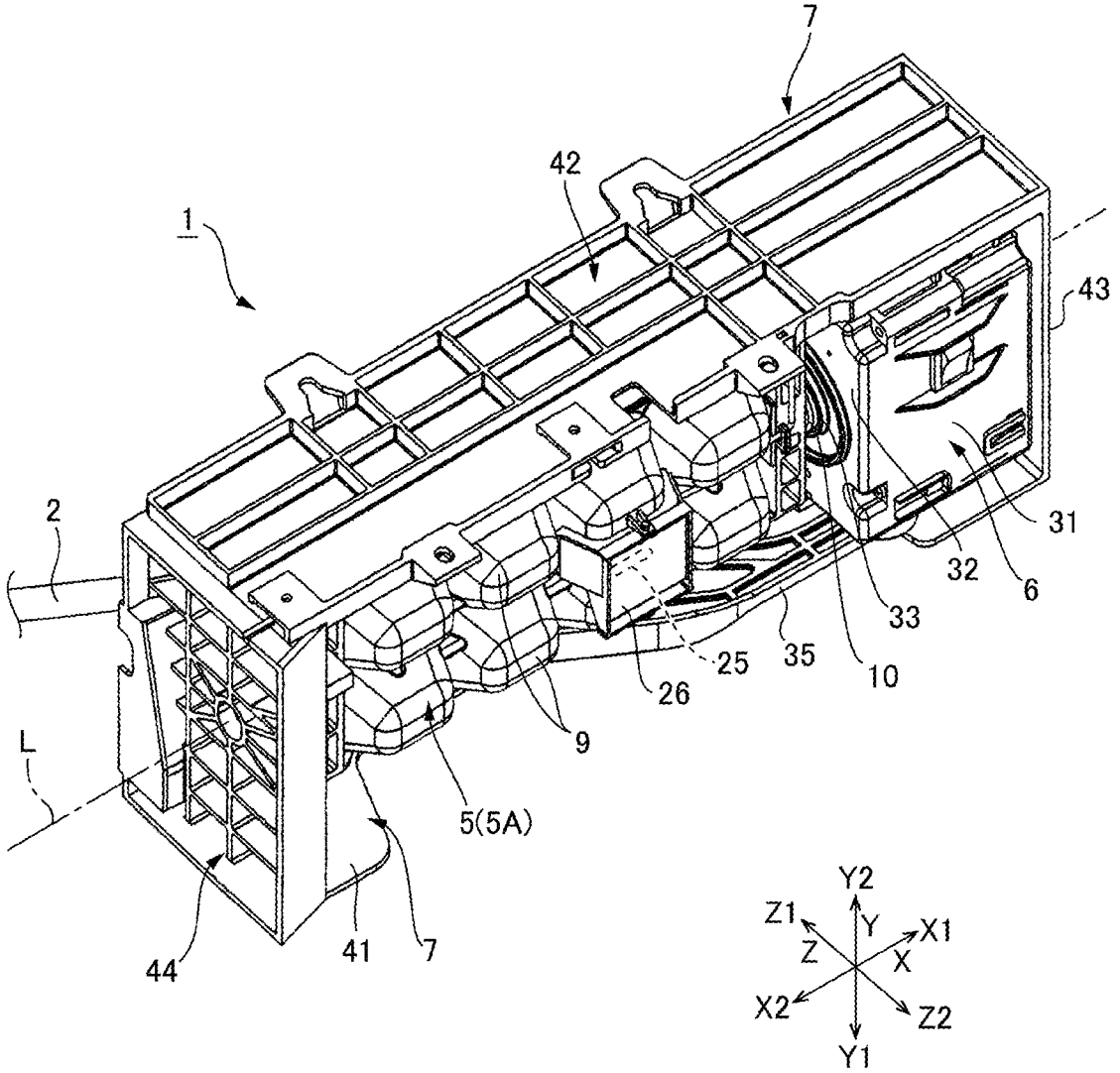
FIG. 2 is a perspective view showing an ice making machine in which an ice tray is located at a water storage position and which is viewed from a lower side.
Figure 3:
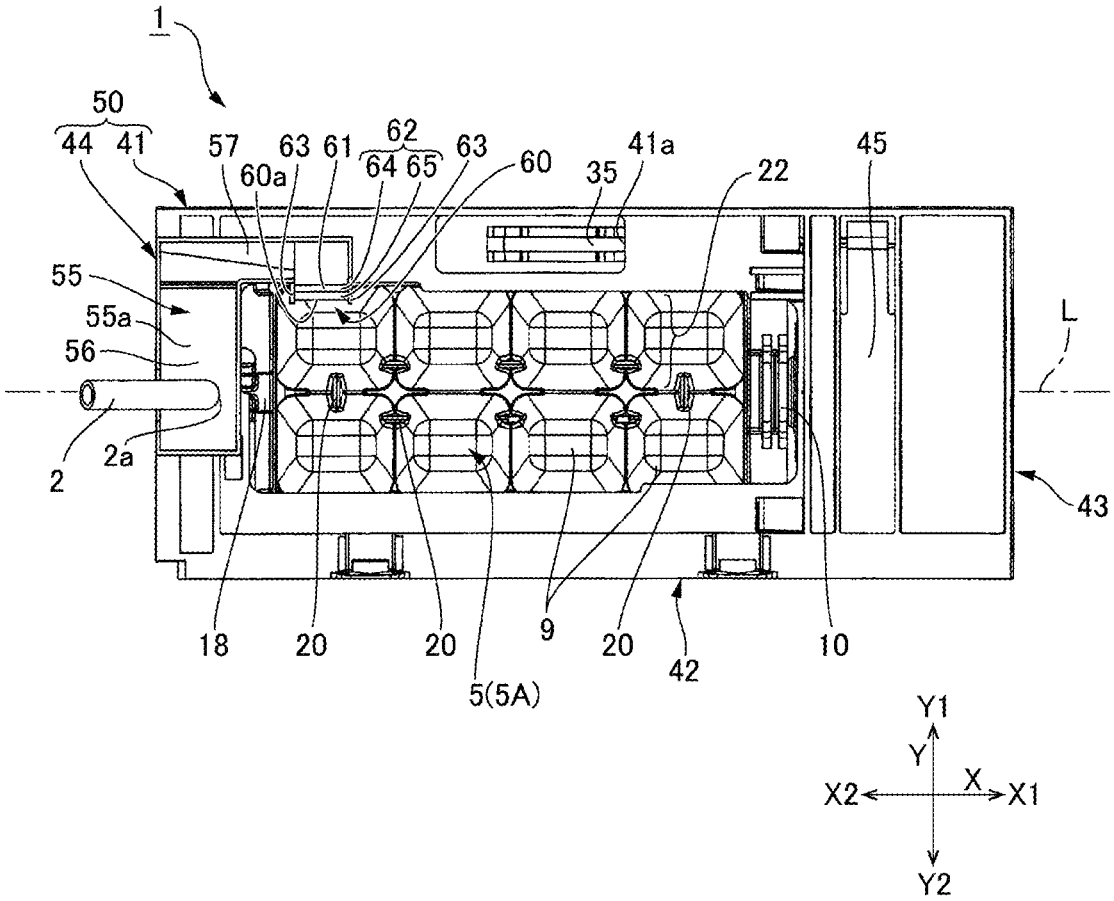
FIG. 3 is a plan view showing an ice making machine in which an ice tray is located at a water storage position and which is viewed from an upper side.
Figure 4:
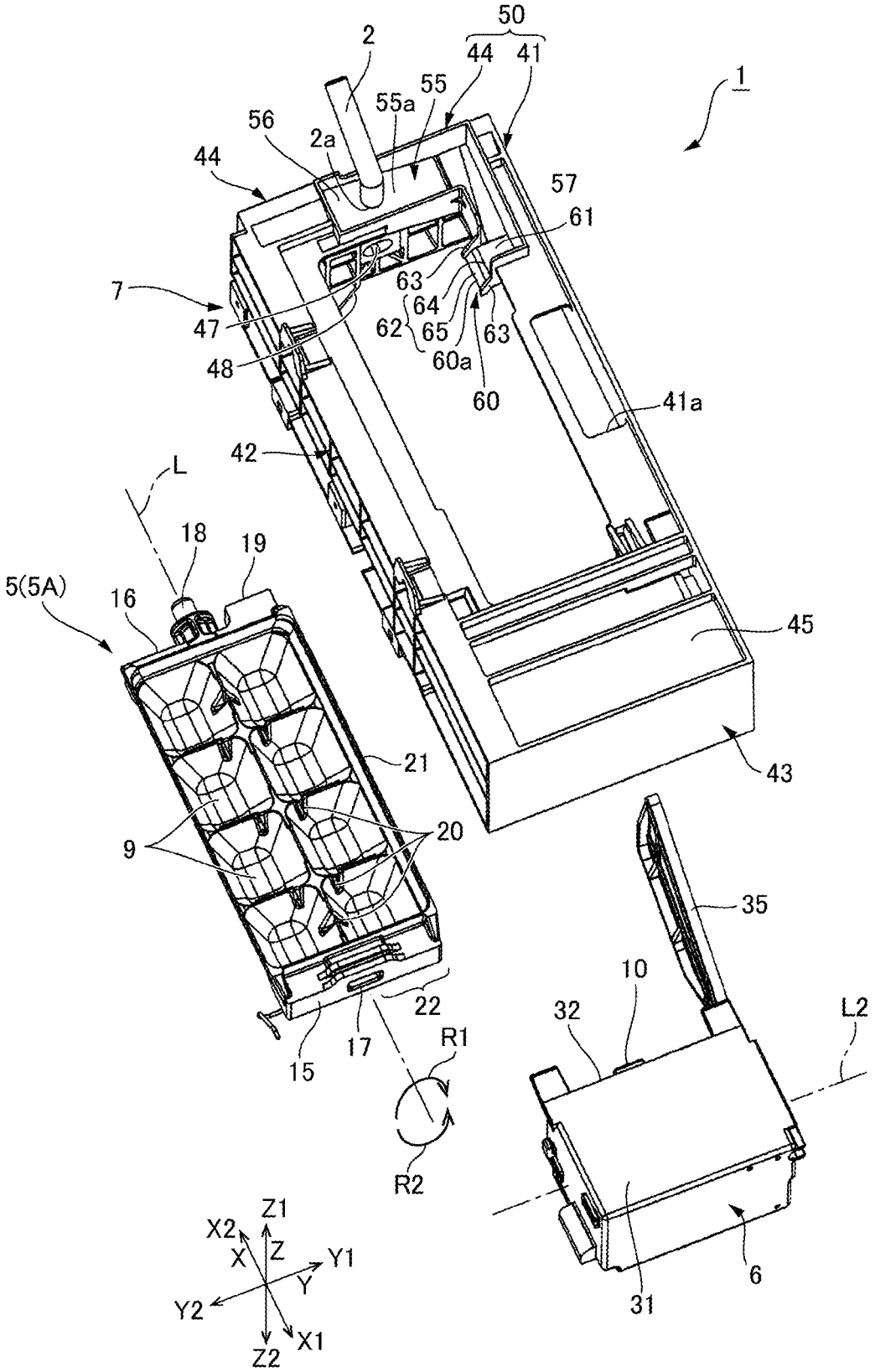
FIG. 4 is an exploded perspective view showing an ice making machine.
Figure 5:
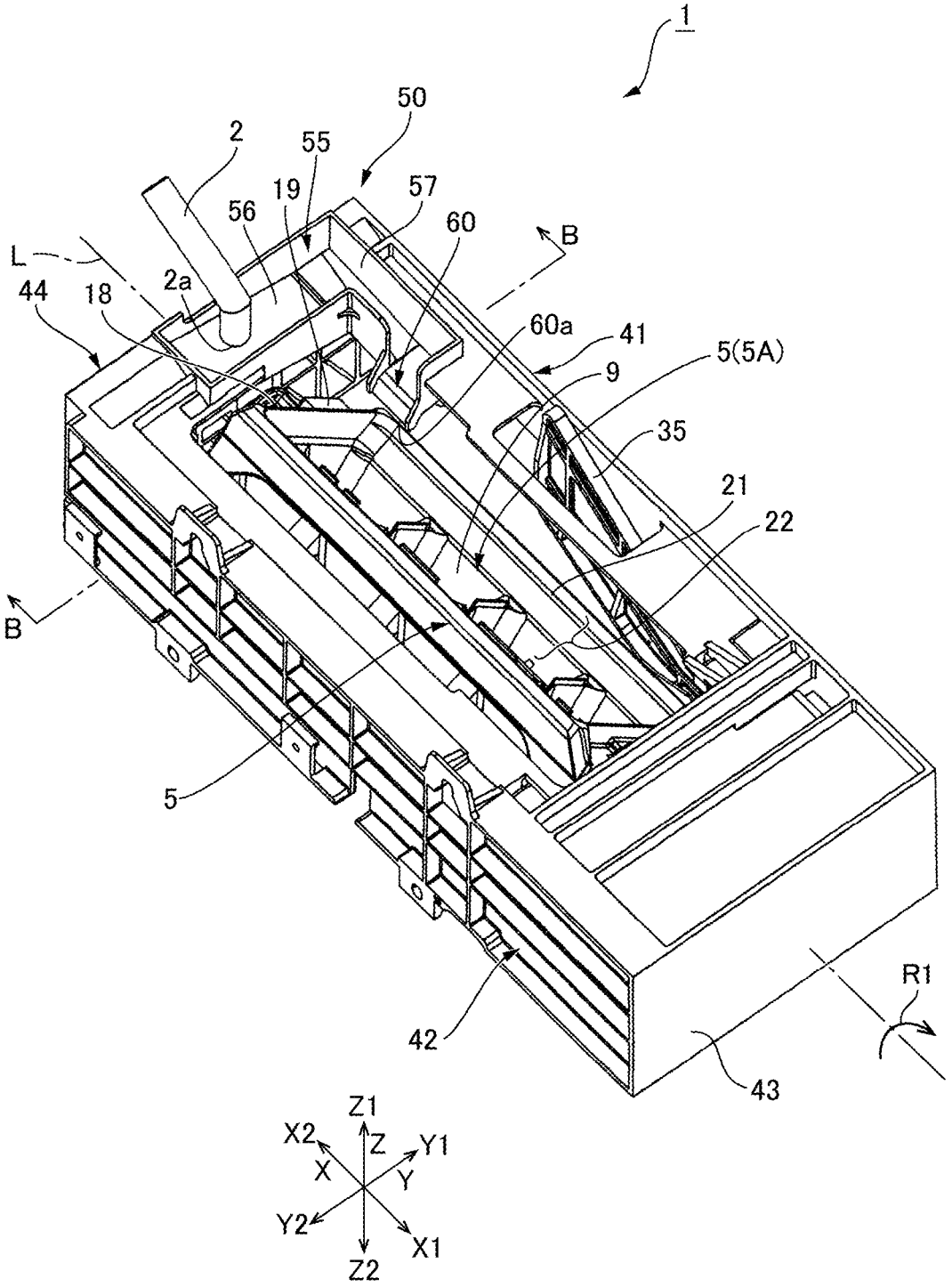
FIG. 5 is a perspective view showing an ice making machine in a state that an ice tray starts turning from a water storage position.
Figure 6:
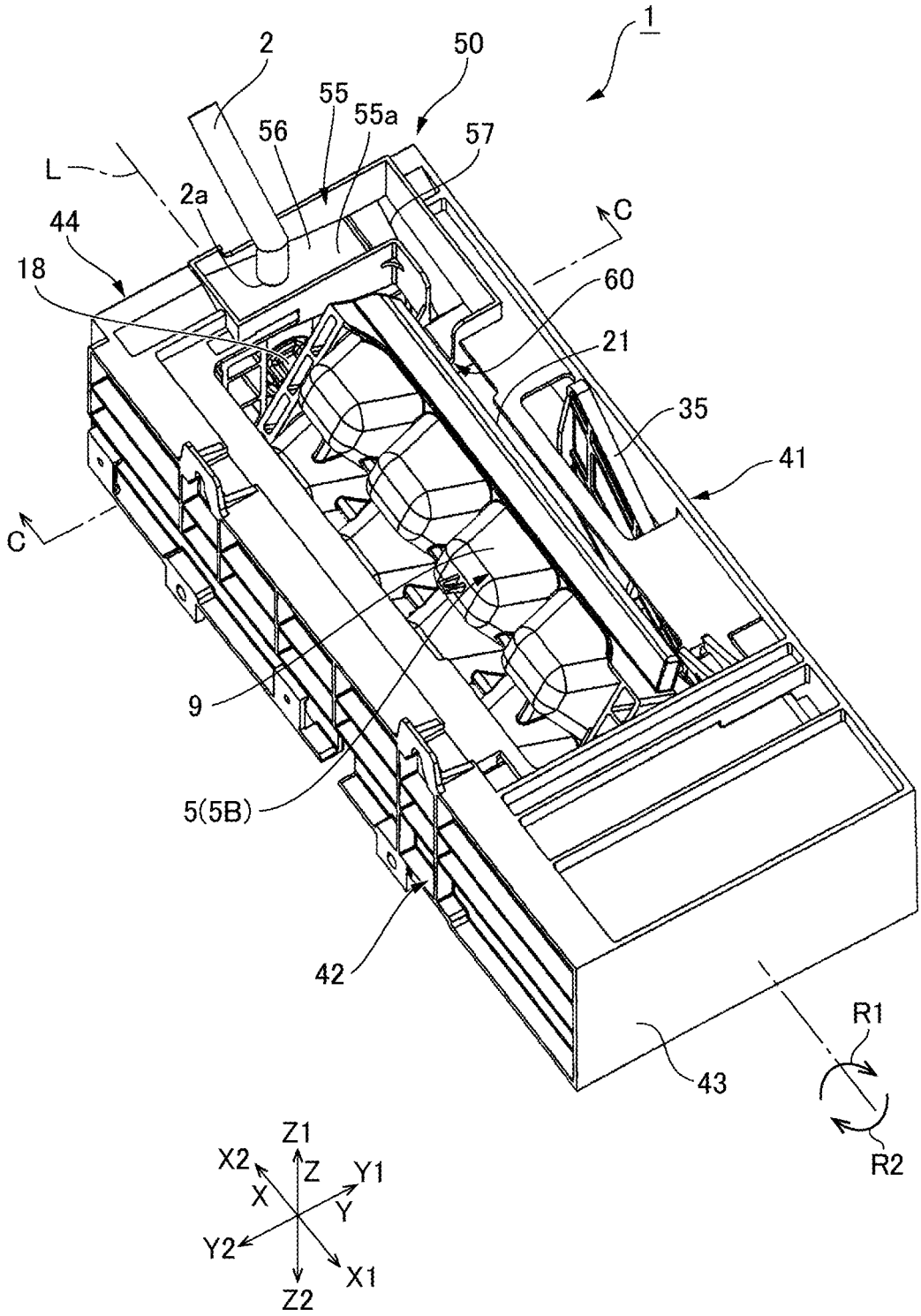
FIG. 6 is a perspective view showing an ice making machine in a state that an ice tray is disposed at an ice separation position.

FIG. 1 is a perspective view showing an ice making machine to which at least an embodiment of the present invention is applied and which is viewed from an upper side. FIG. 2 is a perspective view showing the ice making machine in FIG. 1 which is viewed from a lower side. FIG. 3 is a plan view showing the ice making machine which is viewed from an upper side. In FIG. 1 through FIG. 3, an ice tray is disposed at a water storage position where water for making ice pieces is stored. FIG. 4 is an exploded perspective view showing the ice making machine. FIG. 5 is a perspective view showing the ice making machine in a state that the ice tray starts turning from the water storage position. FIG. 6 is a perspective view showing the ice making machine in a state that the ice tray is disposed at an ice separation position.

An ice making machine 1 is mounted on a refrigerator. As shown in FIG. 1, the ice making machine 1 includes an ice tray 5, a drive part 6 structured to reverse the ice tray 5, and a frame 7 which supports the ice tray 5 and the drive part 6. Further, the ice making machine 1 includes a water supply pipe 2 for supplying water for making ice pieces to the ice tray 5. The water supply pipe 2 is connected with a water tank not shown through a connection pipe 3 (connection water passage). An electromagnetic valve 4 (valve) for opening or closing the connection pipe 3 is installed in a halfway position of the connection pipe 3.

Further, the ice making machine 1 includes a water supply control part 8 structured to drive and control the electromagnetic valve 4. The water supply control part 8 drives and controls the electromagnetic valve 4 to supply a predetermined amount of water with which water in the ice tray 5 is set in a full state to the ice tray 5 through the water supply pipe 2. Further, the water supply control part 8 is structured to repeat opening and closing of the electromagnetic valve 4 while the predetermined amount of water is supplied and intermittently supply water from the water supply pipe 2. In accordance with an embodiment of the present invention, the water supply control part 8 may be integrally provided in a control part of a refrigerator.

The ice tray 5 is formed in a substantially rectangular planar shape. The ice tray 5 is provided with a plurality of water storage recessed parts 9 in which water supplied from the water supply pipe 2 is stored. The drive part 6 is structured to reverse the ice tray 5 around an axial line "L" passing a center portion in a shorter direction of the ice tray 5 in a longitudinal direction. An output shaft 10 of the drive part 6 is connected with an end portion on one side in the axial line "L" direction of the ice tray 5. By driving the drive part 6, the ice tray 5 is turned between a water storage position 5A (see FIG. 1) where the water storage recessed parts 9 face an upper side and an ice separation position 5B (see FIG. 6) where the water storage recessed parts 9 face a lower side.

In the ice making machine 1, as shown in FIG. 1, the ice tray 5 is disposed at the water storage position 5A and a predetermined amount of water supplied from the water supply pipe 2 is stored in the water storage recessed parts 9 of the ice tray 5 to perform ice making. When the ice making is completed, as shown in FIG. 5, the drive part 6 turns the ice tray 5 in a first turning direction "R1" from the water storage position 5A toward the ice separation position 5B to make the ice tray 5 reach the ice separation position 5B shown in FIG. 6. As a result, ice pieces of the ice tray 5 are dropped into an ice storage container (not shown) which is disposed on a lower side with respect to the ice making machine 1.

In the following descriptions, three directions perpendicular to each other are defined as an "X" direction, a "Y" direction and a "Z" direction. The "X" direction is the axial line "L" direction. The "Z" direction is an upper and lower direction in an installation posture (posture shown in FIG. 1) of the ice making machine 1. The "Y" direction is a direction perpendicular to the axial line "L" direction and the upper and lower direction. Further, in the "X" direction, a side where the drive part 6 is located is referred to as an "X1" direction, and a side where the ice tray 5 is located is referred to as an "X2" direction. In the "Z" direction, an upper side is referred to as a "Z1" direction and a lower side is referred to as a "Z2" direction. Further, in the "Y" direction, when the ice tray 5 is turned from the water storage position 5A toward the ice separation position 5B, i.e., in the first turning direction "R1" around the axial line "L", a direction that openings of the water storage recessed parts 9 are directed is referred to as a "Y1" direction, and the opposite side is referred to as a "Y2" direction.

(Ice Tray)

The ice tray 5 is made of an elastically deformable flexible material. In this embodiment, the ice tray 5 is made of resin material. As shown in FIG. 4, the ice tray 5 is provided with a first wall part 15 located in the "X1" direction and a second wall part 16 located in the "X2" direction. The first wall part 15 is provided with a connected part 17 which is connected with an output shaft 10 of the drive part 6. The second wall part 16 is provided with a shaft part 18 coaxially with the connected part 17. The shaft part 18 is protruded from the second wall part 16 in the "X2" direction. Further, the second wall part 16 is provided with a protruded part 19 which is protruded in the "X2" direction at a position separated in the "Y1" direction from the shaft part 18 in a state that the ice tray 5 is disposed at the water storage position 5A.

In the ice tray 5, a plurality of the water storage recessed parts 9 is disposed between the first wall part 15 and the second wall part 16. The water storage recessed parts 9 are disposed in four rows in the "X" direction with two water storage recessed parts 9 arranged in the "Y" direction are paired. The ice tray 5 is provided with communication parts 20 each of which makes two adjacent water storage recessed parts 9 partly communicate with each other. More specifically, the ice tray 5 is provided with the communication parts 20 by which adjacent water storage recessed parts 9 of the four water storage recessed parts 9 arranged in the "X" direction are partly communicated with each other. Further, the ice tray 5 is provided with the communication part 20 which makes two water storage recessed parts 9 arranged in the "Y" direction partly communicate with each other at an end in the "X1" direction. In addition, the ice tray 5 is provided with the communication part 20 which makes two water storage recessed parts 9 arranged in the "Y" direction partly communicate with each other at an end in the "X2" direction. The communication part 20 is a cut-out part which is formed by cutting out a wall located between adjacent water storage recessed parts 9 from an upper side. Further, the ice tray 5 is provided with a peripheral wall part 21 in a rectangular frame shape which is extended to an upper side so as to surround openings of a plurality of the water storage recessed parts 9 when the ice tray 5 is disposed at the water storage position 5A.

In this embodiment, as shown in FIG. 5, a portion of the ice tray 5 which is located in the "Y1" direction with respect to the shaft part 18 when the ice tray 5 is disposed at the water storage position 5A is an ice tray portion 22 which is moved in the "Z2" direction (lower side) when the ice tray 5 starts turning in the first turning direction "R1" from the water storage position 5A to the ice separation position 5B.

As shown in FIG. 2, an under face in the "Z2" direction of the ice tray 5 is arranged with protruded parts which reflect shapes of the water storage recessed parts 9. A thermistor 25 for detecting a temperature of the ice tray 5 is disposed on the under face of the ice tray 5. The thermistor 25 is covered by a cover 26 which is fixed to the under face of the ice tray 5.

(Drive Part)

As shown in FIG. 2, the drive part 6 is provided with a case 31 which is formed in a rectangular parallelepiped shape. The case 31 is accommodated with a motor which is a drive source, a rotation transmission mechanism structured to transmit a rotating force of the motor, and a cam gear to which the rotating force of the motor is transmitted through the rotation transmission mechanism. The cam gear is integrally formed of an output shaft 10. The output shaft 10 is protruded to an outer side of the case 31 through a hole 33 provided in an end plate 32 in the "X2" direction of the case 31. As shown in FIG. 4, the output shaft 10 is connected with the connected part 17 provided in the first wall part 15 of the ice tray 5. The output shaft 10 is turned in a first turning direction "R1" with the axial line "L" as a center when the ice tray 5 is to be turned from the water storage position 5A to the ice separation position 5B. Further, the output shaft 10 is turned in a second turning direction "R2" which is reverse to the first turning direction "R1" when the ice tray 5 is to be returned from the ice separation position 5B to the water storage position 5A.

An ice detection lever 35 is disposed at a position adjacent to the ice tray 5 in the "Y1" direction. In an inside of the case 31 of the drive part 6, an ice detection mechanism, which is structured to operate so as to make an ice detection lever 35 turn around an axial line "L2" (see FIG. 4) in cooperation with the cam gear depending on a turning angle of the cam gear which is turned together with the output shaft 10, and a switch mechanism which is operated based on a signal from the thermistor 25, and the like are structured.

(Frame)

As shown in FIG. 1, FIG. 3 and FIG. 4, the frame 7 is provided with a first frame portion 41 (extended portion), which is extended in the "X" direction on a side in the "Y1" direction with respect to the ice tray 5 and the drive part 6, and a second frame portion 42 extended in parallel with the first frame portion 41 on a side in the "Y2" direction with respect to the ice tray 5 and the drive part 6. Further, the frame 7 is provided with a third frame portion 43, which is extended in the "Y" direction and is connected with ends in the "X1" direction of the first frame portion 41 and the second frame portion 42, and a fourth frame portion 44 (facing portion) which is extended in the "Y" direction and is connected with ends in the "X2" direction of the first frame portion 41 and the second frame portion 42. In addition, the frame 7 is provided with a rectangular support part 45 which is projected in the "X2" direction from an upper end of the third frame portion 43 and partly connects between the first frame portion 41 and the second frame portion 42 on an upper side of the drive part 6. The first frame portion 41 and the second frame portion 42 are separated to a side ("Y" direction) from a turning locus "T" formed by turning of the ice tray 5 around the axial line (see FIG. 7). The third frame portion 43, the fourth frame portion 44 and the support part 45 are separated to a side ("X" direction) from the turning locus "T" formed by turning of the ice tray 5 around the axial line. The drive part 6 is supported in the support part 45.

The first frame portion 41 is overlapped with the ice detection lever 35 when viewed in the "Z" direction. The first frame portion 41 is provided with an opening part 41*a* in which an upper end part of the ice detection lever 35 is located on an inner side. The opening part 41*a* is located in the middle of the first frame portion 41 in the "X" direction. The third frame portion 43 is an end plate which defines an end in the "X1" direction of the frame 7, and a shape of the third frame portion 43 when viewed in the "X" direction is rectangular. The third frame portion 43 covers the drive part 6 which is supported by the support part 45 from the "X1" direction.

The fourth frame portion 44 is a wall having a number of holes which are formed by a plurality of ribs in a plate shape connected with each other. As shown in FIG. 4, a center of a face of the fourth frame portion 44 on a side in the "X1" direction is provided with a shaft hole 47 which turnably supports the shaft part 18 of the ice tray 5. In a state that the connected part 17 of the ice tray 5 is connected with the output shaft 10 of the drive part 6, when the drive part 6 is supported by the support part 45 of the frame 7 and the shaft part 18 of the ice tray 5 is inserted into the shaft hole 47, as shown in FIG. 1 through FIG. 3, the drive part 6 and the ice tray 5 are supported by the frame 7. When the drive part 6 and the ice tray 5 are supported by the frame 7, the ice tray 5 is capable of being turned around the axial line "L" by activation of the drive part 6.

Further, as shown in FIG. 4, the fourth frame portion 44 is provided with an abutted part 48 which is capable of abutting with the ice tray 5 (protruded part 19) from a front side in the first turning direction "R1" when the ice tray 5 is turned around the axial line "L" in the first turning direction "R1" from the water storage position 5A to reach the ice separation position 5B. The abutted part 48 is protruded from the fourth frame portion 44 in the "X1" direction. The abutted part 48 is abutted with the protruded part 19 at the ice separation position 5B to prevent turning of the ice tray 5 which is driven in the first turning direction "R1". As a result, the ice tray 5 is twisted.

In the frame 7, an upper face of a frame portion 50 structured of the first frame portion 41 and the fourth frame portion 44 is provided with a water supply passage 55 through which water supplied from the water supply pipe 2 flows. The water supply passage 55 is formed in a recessed groove shape and its upper side is opened. The water supply passage 55 is provided with a first water supply passage portion 56, which is extended in the "Y" direction (direction intersecting the axial line "L") along the fourth frame portion 44, and a second water supply passage portion 57 extended in the "X" direction along the first frame portion 41 from an end portion in the "Y1" direction of the first water supply passage portion 56. The second water supply passage portion 57 is located on a side in the "X2" direction with respect to the opening part 41*a*. Therefore, the water supply passage 55 is provided in a portion of the frame 7 on a side in the "X2" direction.

Further, the frame 7 is provided with a water pouring part 60 which is protruded in the "Y2" direction (to a side of the turning locus "T" of ice tray 5) from the frame portion 50

(first frame portion 41). The water pouring part 60 is, when a state that the ice tray 5 is located at the water storage position 5A is viewed from an upper side, overlapped with the ice tray portion 22 of the ice tray 5 which is located on a side in the "Y1" direction with respect to the axial line "L". More specifically, the water pouring part 60 is, when a state that the ice tray 5 is located at the water storage position 5A is viewed from an upper side, formed at a position overlapped with the ice tray portion 22 of the ice tray 5 located on a side in the "Y1" direction with respect to the axial line "L" and on a turning center side of the ice tray 5 with respect to the turning locus "T".

As shown in FIG. 3, the water pouring part 60 is communicated with an end portion in the "X1" direction of the second water supply passage portion 57. More specifically, the water supply passage 55 is provided with a water supply outlet 61 which is opened in a face of the first frame portion 41 (frame portion 50) on a side where the ice tray 5 is located. The water pouring part 60 and the water supply passage 55 are communicated with each other through the water supply outlet 61.

In this embodiment, a bottom face 55*a* of the water supply passage 55 is inclined to a lower side toward the water pouring part 60. In other words, the first water supply passage portion 56 is inclined to a lower side toward the "Y1" direction, and the second water supply passage portion 57 is inclined to a lower side toward the "X1" direction from an end portion in the "Y1" direction of the first water supply passage portion 56. Further, an end part in the "X1" direction of the second water supply passage portion 57 is inclined to a lower side toward the water supply outlet 61.

(Water Pouring Part)

Figure 7:
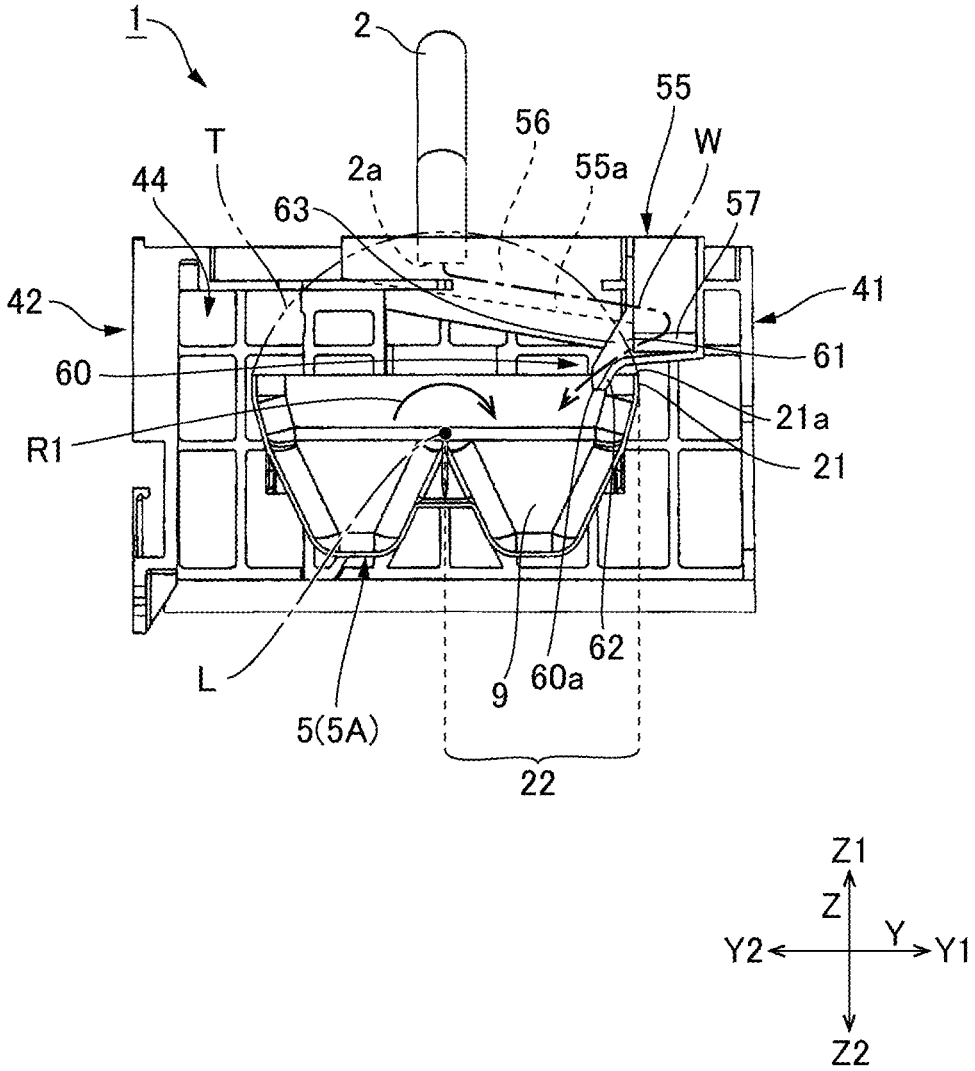
FIG. 7 is a cross-sectional view showing the ice making machine which is cut by the "A-A" line in FIG. 1.
Figure 8:
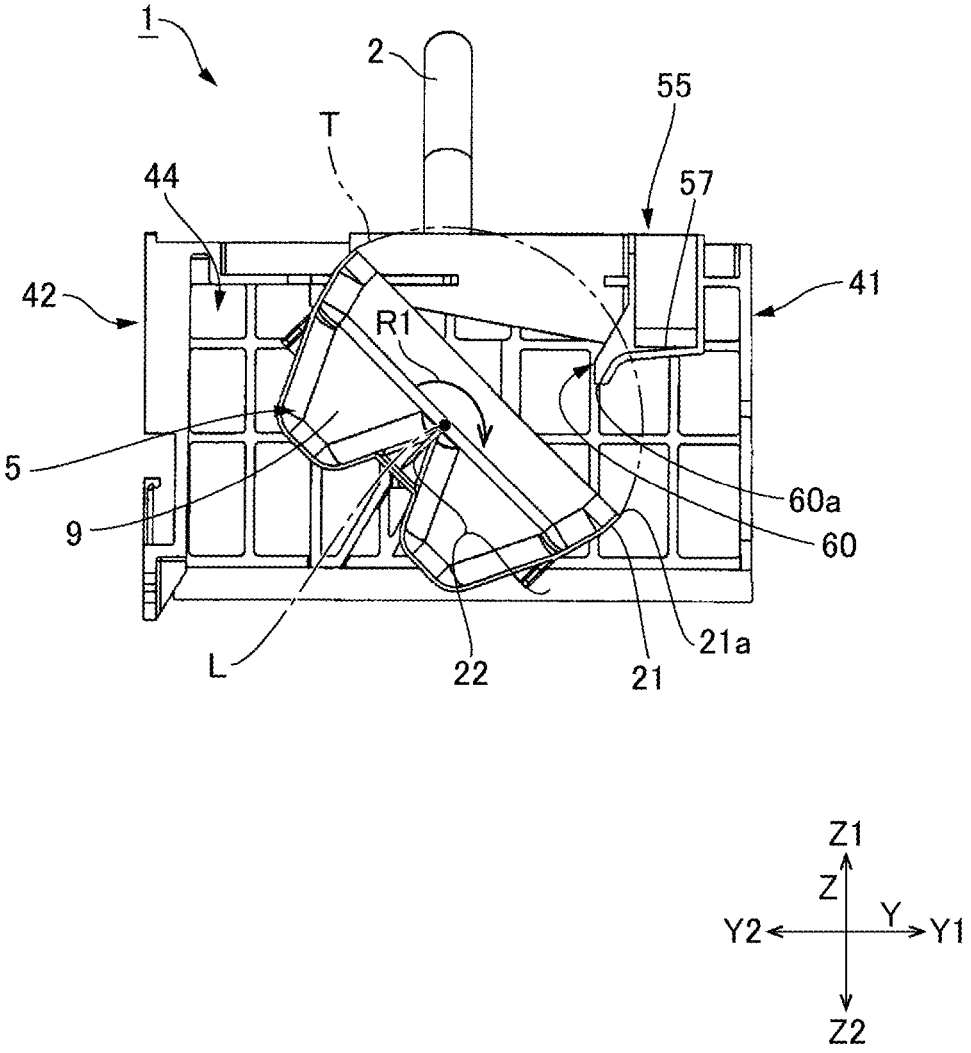
FIG. 8 is a cross-sectional view showing the ice making machine which is cut by the "B-B" line in FIG. 5.
Figure 9:
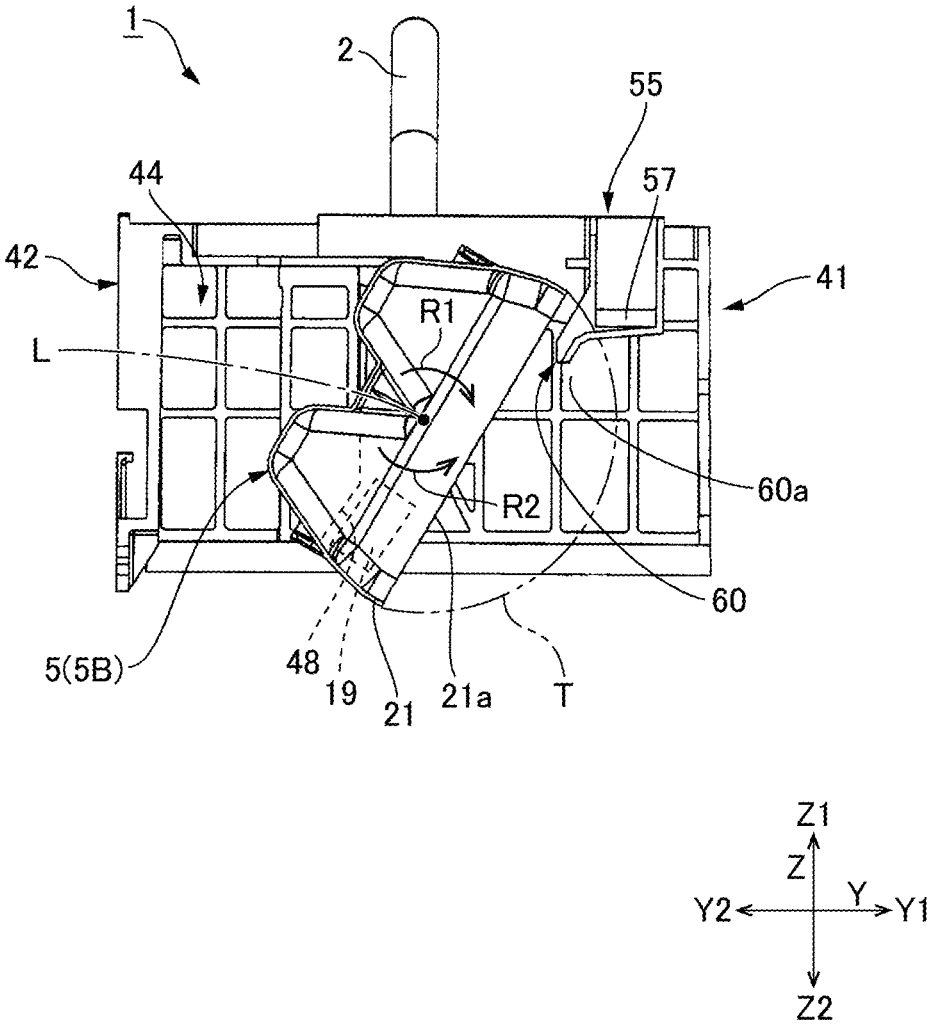
FIG. 9 is a cross-sectional view showing the ice making machine which is cut by the "C-C" line in FIG. 6.

FIG. 7 is a cross-sectional view showing the ice making machine 1 which is cut by the "A-A" line in FIG. 1. FIG. 8 is a cross-sectional view showing the ice making machine 1 which is cut by the "B-B" line in FIG. 5. FIG. 9 is a cross-sectional view showing the ice making machine 1 which is cut by the "C-C" line in FIG. 6. The water pouring part 60 is, as shown in FIG. 1 and FIG. 4, provided with a bottom plate part 62 (bottom part) whose upper face 62*a* is continuously connected with the bottom face 55*a* of the water supply passage 55 (second water supply passage portion 57) through the water supply outlet 61, and a pair of wall parts 63 which are respectively protruded to a side of the ice tray 5 from opening edge portions of the water supply outlet 61 provided in the frame portion 50 so as to face each other with the water supply outlet 61 interposed therebetween.

The bottom plate part 62 is provided with a first inclined plate part 64, which is inclined to a lower side toward the "Y2" direction from the first frame portion 41, and a second inclined plate part 65 which is inclined to a lower side toward the "Y2" direction from a tip end edge of the first inclined plate part 64 with a gradient steeper than that of the first inclined plate part 64. As shown in FIG. 3, a tip end 60*a* of the water pouring part 60 (tip end of the bottom plate part 62) is located on an upper side with respect to the water storage recessed part 9 which is located on a side in the "Y1" direction at an end in the "X2" direction in a plurality of the water storage recessed parts 9. Further, as shown in FIG. 7, the tip end 60*a* of the water pouring part 60 (tip end of the bottom plate part 62) is located on a lower side with respect to an upper end of the ice tray 5 (upper end 21*a* of the peripheral wall part 21) when the ice tray 5 is located at the water storage position 5A. In other words, the tip end of the second inclined plate part 65 is inserted to an inner side with respect to the peripheral wall part 21 of the ice tray 5.

In this embodiment, a water supply port 2*a* of the water supply pipe 2 is located on an upper side with respect to the first water supply passage portion 56.

(Ice Making Operation)

As shown in FIG. 1, in an initial state that an ice making operation is to be started, the ice tray 5 is disposed at the water storage position 5A. In this state, when a water supply command for supplying water is transmitted from a control part of a refrigerator to the water supply control part 8, the water supply control part 8 drives the electromagnetic valve 4 to supply a predetermined amount of water from a water tank to the ice tray 5, and the ice tray 5 is set in a full state with water. Further, while a predetermined amount of water is supplied to the ice tray 5, the water supply control part 8 repeats an opening operation in which the electromagnetic valve 4 is opened by a fixed time period and a closing operation in which the valve is closed. In this manner, the water supply control part 8 intermittently supplies water from the water supply pipe 2 to adjust a flow amount of water which is poured into the water supply passage 55 from the water supply pipe 2 at one time.

As shown by the arrow in an alternate long and short dash line in FIG. 7, water "W" which is poured into the water supply passage 55 from the water supply pipe 2 through the water supply port 2*a* flows from the first water supply passage portion 56 through the second water supply passage portion 57 of the water supply passage 55 toward the water supply outlet 61. Further, the water "W" flows from the water supply outlet 61 to the water pouring part 60 and is poured into the ice tray 5 from the water pouring part 60.

In this embodiment, the bottom face 55*a* of the water supply passage 55 is inclined to a lower side toward the water supply part. Therefore, the water poured into the water supply passage 55 from the water supply pipe 2 is flowed toward the water supply outlet 61 without stagnating. Further, the water pouring part 60 is located at a position overlapping with the ice tray 5 when the ice tray 5 is located at the water storage position 5A. Therefore, the water poured from the water pouring part 60 surely flows to the ice tray 5. In this case, the bottom face 55*a* of the water supply passage 55 is inclined to a lower side toward the water pouring part 60 and thus, when water supply is stopped, the water can be prevented from being left to freeze in the water supply passage 55.

In addition, in the water pouring part 60, the water which flows out from the water supply outlet 61 is guided by a pair of the wall parts 63 along an upper face of the bottom plate part 62 to be led to the ice tray 5. Further, as shown in FIG. 7, the tip end 60*a* of the water pouring part 60 is located on a lower side with respect to the upper end of the ice tray 5 (upper end 21*a* of the peripheral wall part 21) and thus, the water poured from the water pouring part 60 to the ice tray 5 can be stored in the water storage recessed part 9 without splashing outside from the ice tray 5.

Further, the water supply control part 8 repeats an opening and closing operation of the electromagnetic valve 4 at the time of supplying water to adjust an amount of water poured at one time into the water supply passage 55 from the water supply pipe 2 at one time. Therefore, the water which is poured to the water supply passage 55 from the water supply pipe 2 can be prevented from splashing outside from the water supply passage 55 and the water pouring part 60.

In this embodiment, the water which is poured into the ice tray 5 from the water pouring part 60 flows to the water storage recessed part 9 located at the nearest position to the water pouring part 60. Subsequently, the water flows from this water storage recessed part 9 to adjoining water storage recessed parts 9 in the "X" direction and the "Y" direction through the communication parts 20 and is stored in all the water storage recessed parts 9.

When a predetermined amount of the water is supplied from the water supply pipe 2, filling of the water to the water storage recessed parts 9 is completed. After that, the water having been filled in the ice tray 5 is frozen. Whether ice making is completed or not is determined whether a temperature of the ice tray 5 is not more than a predetermined temperature or not by the thermistor 25 which is attached to the ice tray 5.

When ice making is completed, an ice quantity in the ice storage container which is arranged on a lower side with respect to the ice tray 5 is detected by the ice detection lever 35. Specifically, the ice detection lever 35 is driven by the drive part 6 and is moved downward. In this case, in a case that the ice detection lever 35 is moved downward to a predetermined position, it is judged that an inside of the ice storage container is not in a fully filled state with ice pieces. On the other hand, in a case that the ice detection lever 35 contacts with an ice piece within the ice storage container before the ice detection lever 35 is moved downward to the predetermined position, it is judged that the inside of the ice storage container is in a fully filled state with ice pieces. In a case that the inside of the ice storage container is in a fully filled state with ice pieces, after having waited for a predetermined time period, detection of an ice quantity within the ice storage container is performed again by the ice detection lever 35.

In a case that the inside of the ice storage container is not in a fully filled state with ice pieces, ice pieces are separated from the ice tray 5 and are dropped to the ice storage container. Specifically, as shown in FIG. 5 and FIG. 8, the ice making machine 1 turns the output shaft 10 in the first turning direction "R1" by driving the drive part 6 and thereby, the ice tray 5 is turned in the first turning direction "R1" around the axial line "L".

In this embodiment, as shown in FIG. 3, the water pouring part 60 is protruded from the first frame portion 41 of the frame 7 to a side of the ice tray 5 and, when a state that the ice tray 5 is located at the water storage position 5A is viewed from an upper side, the water pouring part 60 is overlapped with the ice tray 5. However, the ice tray portion 22 with which the water pouring part 60 is overlapped is located to a side in the "Y1" direction with respect to the axial line "L" in the ice tray 5 and thus, when the ice tray 5 is turned in the first turning direction "R1", the ice tray portion 22 is moved to a lower side. Therefore, as shown in FIG. 8, the ice tray 5 is separated from the water pouring part 60 with the ice tray 5 being turned in the first turning direction "R1". Accordingly, when the ice tray 5 is turned, the water pouring part 60 protruded from the frame 7 and the ice tray 5 to be turned are not interfered with each other.

The ice tray 5 is turned by a predetermined turning angle not less than 90° (for example, 120°) from the water storage position 5A where the ice tray 5 is horizontally disposed to reach the ice separation position 5B shown in FIG. 6 and FIG. 9. As shown in FIG. 9, at the ice separation position 5B, the protruded part 19 of the ice tray 5 is abutted with the abutted part 48 of the frame 7.

In this embodiment, at the time when the protruded part 19 of the ice tray 5 is abutted with the abutted part 48 of the frame 7, although the ice tray 5 is driven by the drive part 6 in the first turning direction "R1", the ice tray 5 is prevented from further being turned in the first turning direction "R1" by the abutted part 48 abutted with the protruded part 19. As a result, the ice tray 5 is twisted and deformed. Therefore, ice pieces in the inside of the ice tray 5 are detached from the water storage recessed parts 9 and are separated from the ice tray 5 and thus, the ice pieces drop into the ice storage container.

In a state that the ice tray 5 is disposed at the ice separation position 5B, the water pouring part 60 is separated on a front side in the first turning direction "R1" with respect to the ice tray 5. In the state that the ice tray 5 is disposed at the ice separation position 5B, the ice tray 5 is prevented from further being turned in the first turning direction "R1" by the abutted part 48 abutted with the ice tray 5 (protruded part 19). Therefore, the ice tray 5 and the water pouring part 60 are not interfered with each other.

After that, the drive part 6 turns the ice tray 5 in a direction of the second turning direction "R2" and returns the ice tray 5 to the water storage position 5A where the water storage recessed parts 9 face an upper side. Further, the above-mentioned ice making operation is repeated.

(Operations and Effects)

In at least an embodiment of the present invention, water from the water supply pipe 2 is supplied to the water supply passage 55 provided in the frame portion 50 of the frame 7 which is located on a side with respect to the turning locus "T" of the ice tray 5, and the water flows into the water pouring part 60 from the water supply passage 55 to pour into the water storage recessed part 9 from the water pouring part 60. Therefore, the water supply port 2*a* of the water supply pipe 2 can be located on a side with respect to the ice tray 5. As a result, the water supply port 2*a* of the water supply pipe 2 is not required to dispose at a position separated from the turning locus "T" of the ice tray 5 on an upper side with respect to the ice tray 5 and thus, an installation space of the ice making machine 1 including the water supply pipe 2 can be reduced in the "Z" direction.

Further, in this embodiment, the water supply passage 55 is provided in the upper face 62*a* of the frame 7 at a position separated in the "X" direction from the drive part 6. Therefore, even in a case that water poured from the water supply pipe 2 into the water supply passage 55 splashes, the water can be prevented from splashing on the drive part 6.

Modified Embodiments

In the embodiment described above, the water supply port 2*a* of the water supply pipe 2 is installed so as to be located in a center portion in the "Y" direction of the first water supply passage portion 56 of the water supply passage 55. However, the water supply pipe 2 may be disposed at any position in the "Y" direction when the water supply port 2*a* is disposed on an upper side with respect to the first water supply passage portion 56. Further, the water supply pipe 2 may be disposed at any position in the "X" direction when the water supply port 2*a* is located on an upper side with respect to the second water supply passage portion 57. In other words, in the ice making machine 1 in this embodiment, the water supply passage 55 is provided with the first water supply passage portion 56 provided in an upper face of the fourth frame portion 44 and the second water supply passage portion 57 provided in an upper face of the first frame portion 41 and thus, a degree of freedom of an arrangement of the water supply pipe 2 for supplying water to the water supply passage 55 is high.

Further, the water pouring part 60 may be protruded to a side of the ice tray 5 (to the "X1" direction) from the fourth frame portion 44. Also in this case, when the water pouring part 60 is provided at a position overlapping with the ice tray portion 22 in a case that a state that the ice tray 5 is located at the water storage position 5A is viewed from an upper side, an interference of the ice tray 5 to be turned and the water pouring part 60 can be avoided. Further, in this case, when a water supply outlet is provided in a face on the "X1" direction side of the fourth frame portion 44, the first water supply passage portion 56 and the water pouring part 60 can be communicated with each other. Further, also in this case, the bottom face 55*a* of the water supply passage 55 is structured so as to be inclined to a lower side toward the water pouring part 60.

The invention claimed is:

1. An ice making machine comprising:

an ice tray comprising a water storage recessed part in which water supplied from a water supply pipe is stored;

a drive part structured to reverse the ice tray around an axial line passing the ice tray between a water storage position where the water storage recessed part faces an upper side and an ice separation position where the water storage recessed part faces a lower side; and a frame which supports the ice tray and the drive part;

wherein the drive part is connected with one side of the ice tray in a direction of the axial line, wherein the frame comprises:

a facing portion which faces the drive part with the ice tray interposed therebetween in the direction of the axial line; and an extended portion which is extended from the facing portion to the one side in the direction of the axial line so as to be separated to a side from a turning locus formed by turning of the ice tray;

wherein the extended portion is provided on a side where the ice tray is moved to a lower side when the ice tray starts turning in a first turning direction from the water storage position toward the ice separation position;

wherein upper faces of the facing portion and the extended portion comprise a water supply passage for pouring the water into the water storage recessed part;

wherein the water supply passage comprises:

a first water supply passage portion which is provided on the upper face of the facing portion; and a second water supply passage portion which is provided on the upper face of the extended portion;

wherein the extended portion comprises a water pouring part protruded from the extended portion to a side of the turning locus and communicated with an end portion of the second water supply passage portion for pouring the water into the water storage recessed part;

wherein the water pouring part is provided on an upper side with respect to an ice tray portion of the ice tray which is moved to the lower side when the ice tray turning in the first turning direction from the water storage position toward the ice separation position;

wherein when the ice tray is located at the water storage position, the water pouring part is protruded to an upper side of the water storage recessed part over an upper end of the ice tray, and a tip end of the water pouring part is located on a lower side with respect to the upper end of the ice tray;

wherein the water supplied from the water supply pipe is supplied to the water supply passage and is poured into the water storage recessed part through the water pouring part; and wherein the upper end of the ice tray over which the water pouring part is protruded to the upper side of the water storage recessed part is moved to the lower side so as not to abut with the water pouring part when the ice tray starts turning in the first turning direction from the water storage position toward the ice separation position.

2. The ice making machine according to claim 1, wherein the ice tray is made of flexible material, the facing portion comprises an abutted part which is abutted with the ice tray from a front side in the first turning direction when the ice tray is turned in the first turning direction and reaches the ice separation position and thereby, turning of the ice tray driven in the first turning direction is prevented, and the water pouring part is separated on the front side in the first turning direction of the ice tray in a state that the ice tray is abutted with the abutted part.

3. The ice making machine according to claim 1, wherein a bottom face of the water supply passage is inclined to a lower side toward the water pouring part.

4. The ice making machine according to claim 1, wherein the second water supply passage portion comprises a water supply outlet which is opened on a side where the ice tray is located, the water pouring part and the second water supply passage portion are communicated with each other through the water supply outlet, and the water pouring part comprises:

a bottom part whose upper face is continuously connected with a bottom face of the second water supply passage portion through the water supply outlet; and a pair of wall parts which are respectively protruded to a side of the ice tray from opening edge portions of the water supply outlet so as to face each other with the water supply outlet interposed therebetween, a lower end of each of the wall parts being connected with the bottom part.

5. The ice making machine according to claim 1, wherein the ice tray comprises:

a plurality of water storage recessed parts; and a communication part which is a cut-out part through which two of the water storage recessed parts adjacent to each other are partly communicated with each other so that the water is capable of flowing into the water storage recessed part through the communication part.

6. The ice making machine according to claim 1, comprising:

the water supply pipe;

a connection water passage which connects a water tank with the water supply pipe;

an electromagnetic valve structured to open and close the connection water passage; and a water supply controller which drives and controls the electromagnetic valve to supply a predetermined amount of water to the ice tray from the water supply pipe, wherein the water supply controller repeats opening and closing of the electromagnetic valve while the predetermined amount of the water is supplied and the water is intermittently flowed out from the water supply pipe.

* * * * *